US006917024B2

(12) United States Patent
Lee et al.

(10) Patent No.: US 6,917,024 B2
(45) Date of Patent: Jul. 12, 2005

(54) HEATING APPARATUS IN MICROWAVE OVEN

(75) Inventors: Young Min Lee, Incheon-si (KR); Yang Kyeong Kim, Bucheon-si (KR); Wan Soo Kim, Gwangmyeong-si (KR); Jong Sik Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/766,937

(22) Filed: Jan. 30, 2004

(65) Prior Publication Data

US 2004/0251251 A1 Dec. 16, 2004

(30) Foreign Application Priority Data

Jun. 12, 2003 (KR) ..... 10-2003-0037966

(51) Int. Cl.[7] ..... H05B 6/64
(52) U.S. Cl. ..... 219/752; 219/706
(58) Field of Search ..... 219/752, 706, 219/756, 702, 704, 725, 719, 731, 732, 733, 735, 738, 759, 682, 705, 712, 680, 694, 746, 687, 688; 122/6 A; 165/81; 261/139, DIG. 48, DIG. 55

(56) References Cited

U.S. PATENT DOCUMENTS 4,518,839 A * 5/1985 Taguchi et al. ..... 219/713
5,270,510 A * 12/1993 Aoki et al. ..... 219/706

FOREIGN PATENT DOCUMENTS

JP 08171987 A * 7/1996 ..... H05B/6/78
JP 09050884 A * 2/1997 ..... H05B/6/64

* cited by examiner

*Primary Examiner*—Quang T. Van
(74) *Attorney, Agent, or Firm*—Fleshner & Kim, LLP

(57) ABSTRACT

A heating apparatus for use in a microwave oven includes a tray which is used as a medium of an ultrasonic oscillator. The heating apparatus has a cavity formed inside of a case of the apparatus. A tray is installed inside of the cavity, on which the article to be heated is positioned. An oscillating device is connected to the tray for oscillating the tray and/or the article to be heated. The oscillating device can be an ultrasonic oscillator.

9 Claims, 5 Drawing Sheets

HEATING APPARATUS IN MICROWAVE OVEN

BACKGROUND OF THE INVENTION

1. Field of the Invention

The present invention relates to a heating apparatus in a microwave oven in which one of microwave oven elements, namely a tray in a cavity where a food article to be cooked is usually placed is used as a medium of an ultrasonic oscillator.

2. Discussion of the Background Art

In general, a microwave oven cooks a food article positioned in a cooking chamber by application of heat energy from an electric heater as a heat source. Another auxiliary heat source, magnetron for example, is sometimes installed to use microwaves as a separate heat source.

FIG. 1 is a schematic perspective view illustrating a main part of a related art microwave oven.

As shown in FIG. 1, the microwave oven includes a case 1; a cavity 2 formed inside of the case 1; a door 3 pivotably fastened to the entire low surface of the case 1 to be able to open/close the cavity 2; an operation display 5 installed at a top front surface of the cavity 2, displaying an operation state of every button needed for operation of the microwave and displaying a state of the oven; a lower heater 7 installed between a low portion of the cavity 2 and the case, providing heat through the bottom of the cavity 2; an upper heater 9 installed at an upper portion of the cavity 2, heating a food article inside the cavity with radiant heat from the heater; a convection heater 11 installed between the bottom surface of the cavity 2 and the case 1; a convection fan 13 installed at the bottom surface of the cavity 2, supplying heated air by the convection heater 11 into the cavity 2; a cooling fan 17 installed between the upper portion of the cavity 2 and the case 1, cooling electric elements; an oven lamp 18 for illuminating an inside of the cooking chamber; and a magnetron 15 for generating microwaves for cooking the food article.

On the top end of the door 3 is a knob 4. Thus, when a user wants to open the cavity 2, he or she needs to pull the knob 4 installed at the top end of the door 3. What happens then is the door is rotated by means of a hinge connecting the lower end of the case 1 with the door 3, and the closed cavity 2 is opened.

Also, to supply heated air by the convection heater 11 into the cavity 2 through an operation of the convection fan 13, a plurality of air passage holes 14 are perforated on the bottom surface of the cavity 2 opposed to the convection heater 11.

FIG. 2 is a state diagram illustrating a food article positioned inside of the related art microwave oven's cavity being cooked by heat from a heater and by magnetron.

An operation of the related art microwave oven with the above configuration is now described.

When a user places a food article at an inside of the cavity 2 and closes the door 3, the cavity 2 starts cooking the food article while the cavity 2 is being shut by the door 3. At this point, heat generated from the lower heater 7, which is installed between the lower portion of the cavity 2 and the case 1, is conducted to the bottom surface of the cavity 2, and the conducted heat is eventually transmitted to the food article through air circulation inside of the cavity 2 and through a tray where the food article is placed.

Moreover, heat generated from the upper heater 9, which is installed at the upper portion of the cavity 2, is transmitted to the food article through radiation and convection. Further, by operation of the convection fan 13, heat from the convection heater 11 is also transmitted in form of hot wind to the food article via the plurality of air passage holes 14 formed on the bottom surface of the cavity 2.

However, the related art microwave oven poses a serious problem in its heating method. For example, a part of the food article is cooked by heat from the upper heater 9 installed at the top end of the cavity 2 through radiation and convection, as shown in FIG. 2. In this case, since an inside temperature of the cavity 2 is forcefully mixed by the convection fan 13, the inside of the cavity 2 can have a homogenous temperature field overall. However, there is a limit to get the heat to be effectively absorbed by the food article placed at the tray 19 though the above heating method. Particularly, when the heater 9 is used to cook the food article, heat is not evenly reached the inside of the food article, but only the surface area of the food article is cooked, resulting in overcooking or burning the surface of the food article.

To prevent the surface of the food article from burning by heat from the heater 9, manufacturers made the heater 9 to be turned on/off as needed. However, it turned out that this turning on/off method only prolonged the cooking time more than necessary.

SUMMARY OF THE INVENTION

An object of the invention is to solve at least the above problems and/or disadvantages and to provide at least the advantages described hereinafter.

Accordingly, one object of the present invention is to solve the foregoing problems by providing a heating apparatus in a microwave oven that is capable of greatly reducing cooking time, by using a metal tray inside of a cavity where a food article to be cooked is placed as a medium of ultrasonic oscillation generated from an oscillating means and by transmitting ultrasonic waves to the food article to activate molecular structures of the food article, whereby heating speed by heater applied to the food article can be uniform on both surface and inside of the food article and simultaneously, cooking time can be greatly reduced according to the uniform heating speed applied to the food article.

The foregoing and other objects and advantages are realized by providing a heating apparatus having a means for heating an article in a microwave oven, including: a cavity formed inside of a case of the apparatus; a tray installed inside of the cavity, on which the article to be heated is positioned; and an oscillating means connected to the tray for oscillating the tray.

In an embodiment of the invention, the oscillating means is in contact with the tray, and fastened at a predetermined position on the cavity by means of a fixing means.

In an embodiment of the invention, the oscillating means is in contact with the tray, and fastened to the case by using a bracket as a fixing means.

In an embodiment of the invention, the bracket and the case are fastened to each other by means of a hook-shaped suspender or a coupling of a bolt and a nut.

According to the invention, by using a food article-holding tray inside of the cavity as the medium of an ultrasonic oscillator, molecular structures of a food article are activated, and thus, heating speed applied to the food article by a heater can be uniform at the surface as well as at the inside of the food article. As the inside and the outside of the food article are heated at a uniform heating speed, cooking time can be greatly reduced.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF PREFERRED EMBODIMENTS

The following detailed description will present a heating apparatus in a microwave oven according to a preferred embodiment of the invention in reference to the accompanying drawings.

According to the heating apparatus in a microwave oven of the present invention, ultrasonic waves generated by an oscillating means are transmitted to a food article to be heated and activate molecular structures of the food article. Using heat from a heater and a magnetron, heating speed applied to the surface and the inside of the food article is uniform, and thus, cooking time can be greatly reduced.

Figure 1:
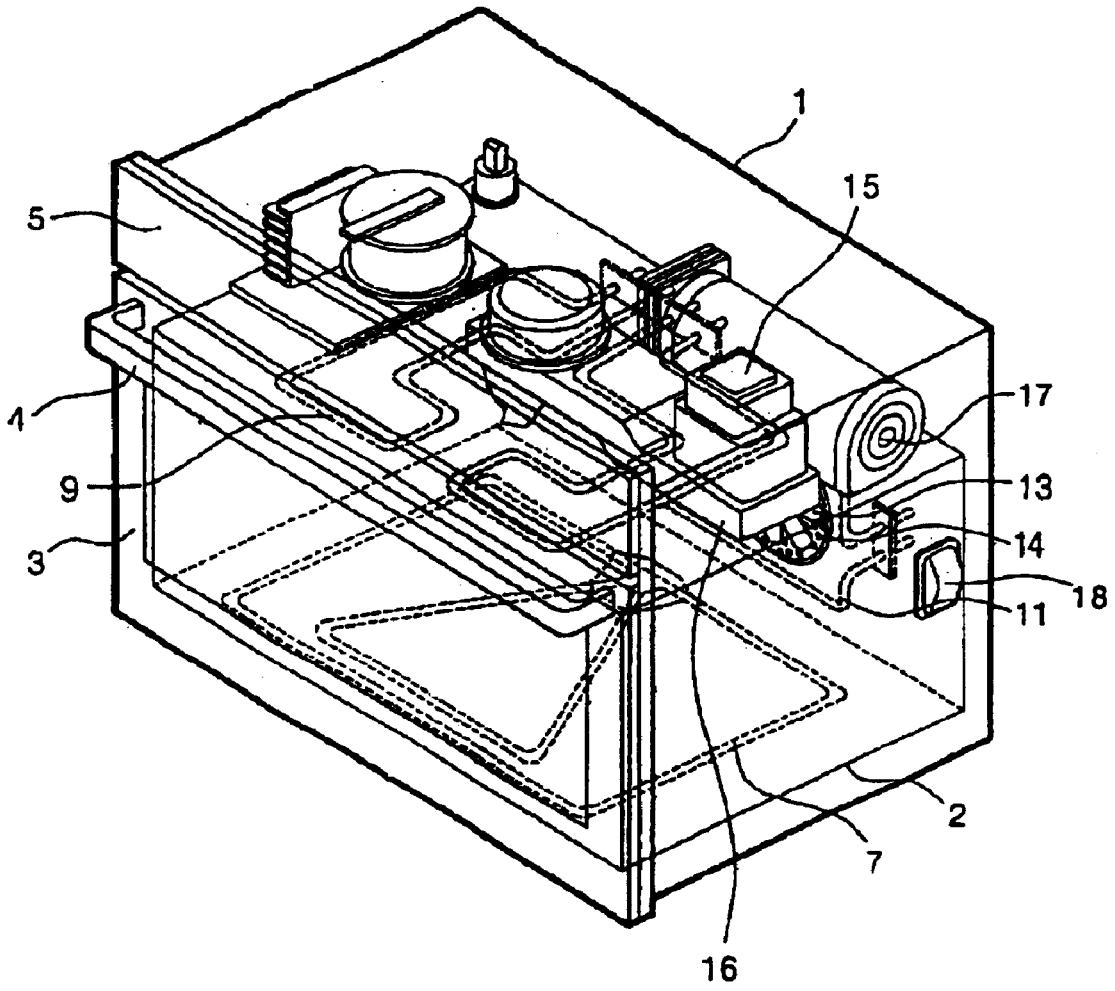
Fig.1 Related Art
FIG. 1 is a schematic perspective view illustrating a main part of a related art microwave oven.
Figure 2:
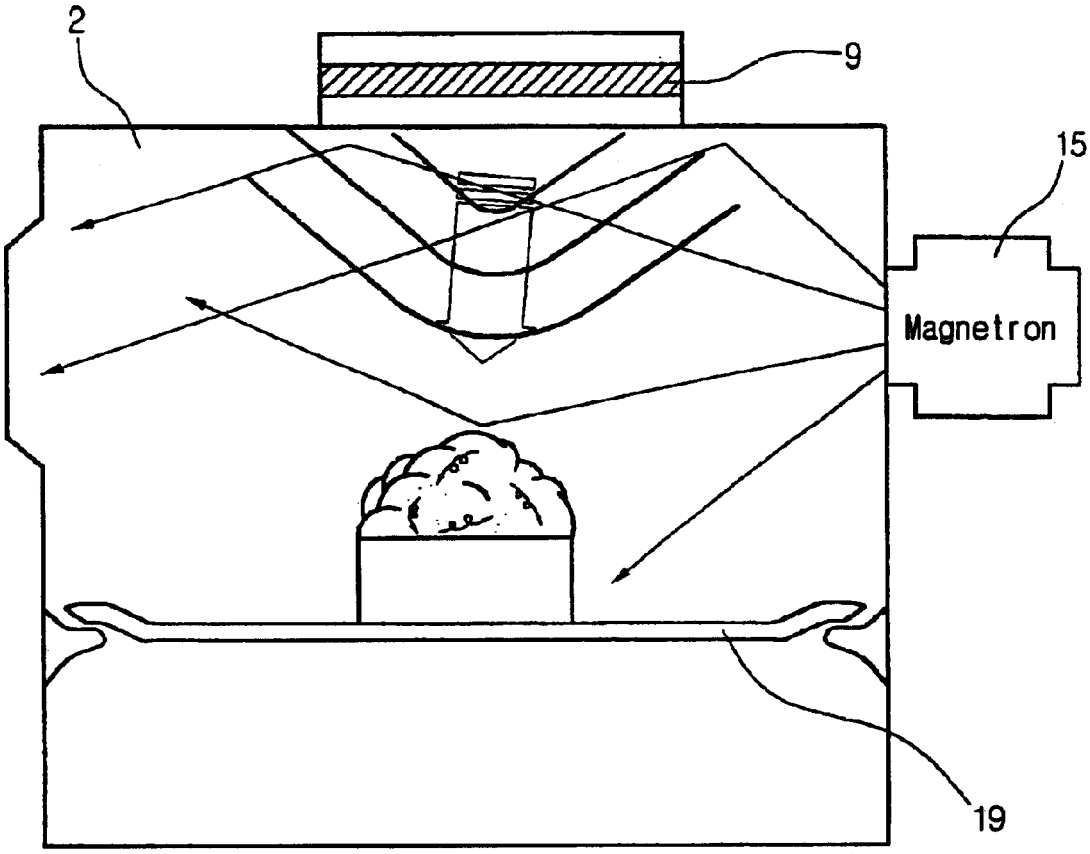
Fig.2 Related Art
FIG. 2 is a state diagram illustrating a food article positioned inside of a related art microwave oven's cavity being cooked by heat from a heater and by magnetron.
Figure 3:
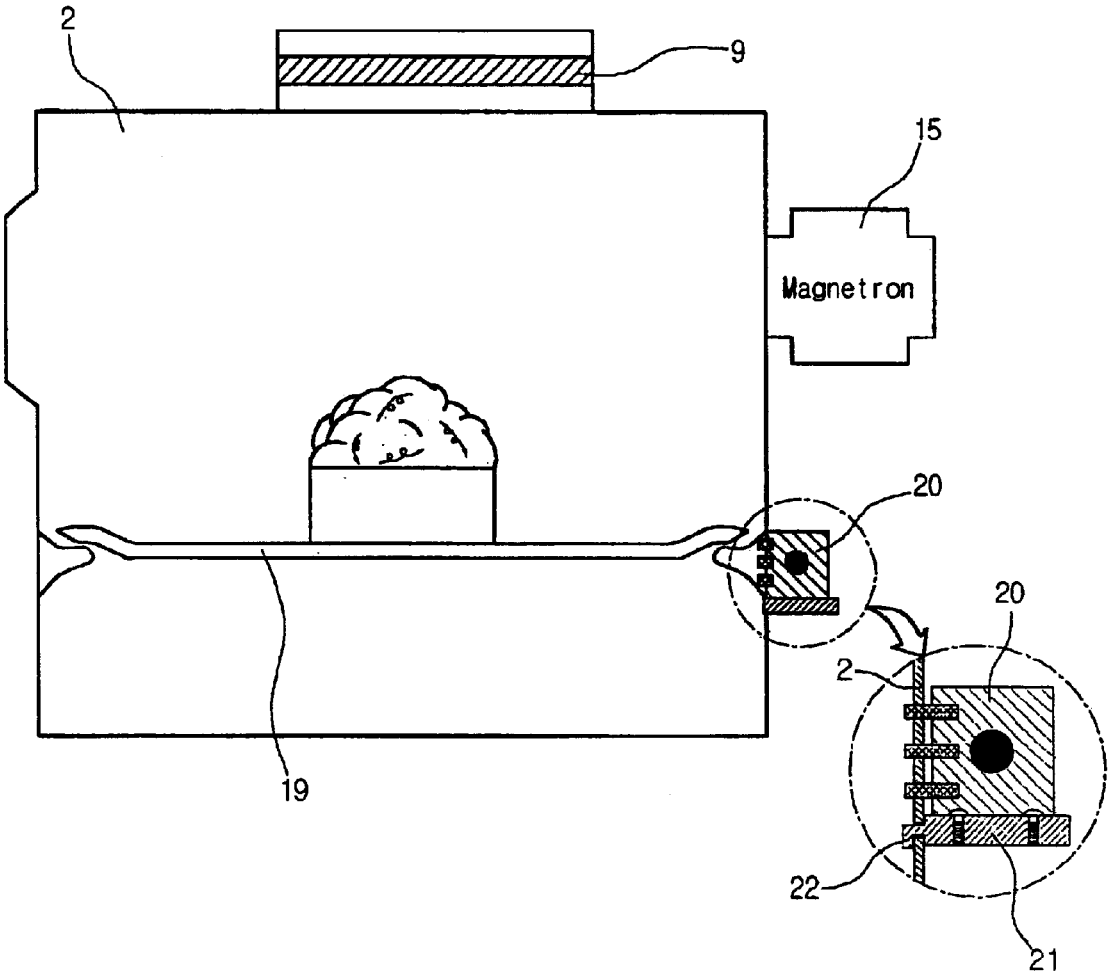
FIG. 3 illustrates a detailed configuration of a cavity out of main elements of a microwave oven according to a preferred embodiment of the present invention, in which an ultrasonic oscillator is installed at the cavity.

FIG. 3 illustrates a detailed configuration of a cavity out of main elements of the microwave oven according to the present invention, in which an ultrasonic oscillator is installed at the cavity.

Referring to FIG. 3, the heating apparatus in a microwave oven of the invention includes a cavity 2 formed inside of a case; a tray 19 installed inside of the cavity 2, on which a food article is positioned; a heater 9 installed at an upper part and a lower part of the cavity 2, heating the food article inside of the cavity 2 through radiation or convection; and an ultrasonic oscillator 20 installed at a predetermined position of the cavity 2 to be in contact with the tray 19, activating molecular structures of the food article placed on the tray 19 by using ultrasonic waves.

As shown in FIG. 3, a bracket 21 is used to ensure that the ultrasonic oscillator 20 is firmly fastened at the predetermined outside position of the cavity 2 in contact with the tray 19. Here, the bracket 21 can be fastened to the cavity 2 by means of a hook-shaped suspender 22, or a coupling of a bolt and a nut.

More details on the heating apparatus in the microwave oven of the present invention are now provided.

Using the tray 19 inside of the cavity 2 where the food article is positioned as a medium of the ultrasonic oscillator 20, ultrasonic waves from the ultrasonic oscillator 20 are transmitted to the food article. Specifically, the ultrasonic oscillator 20 is installed at the predetermined outside position of the cavity 2 in contact with the tray 19. As a result, molecular structures of the food article are activated, and at the same time, heating speed of the food article, that is, heating speed by application of heat from the heater 9, is uniform both on the surface of the food article and inside of the food article.

The microwave oven elements of the invention are identical with those in the related art microwave oven discussed before, so like numerals are used for like and corresponding parts of the various drawings.

Therefore, detailed description of the invention will mainly be focused on the heating apparatus in the microwave oven having an oscillating means.

Figure 4:
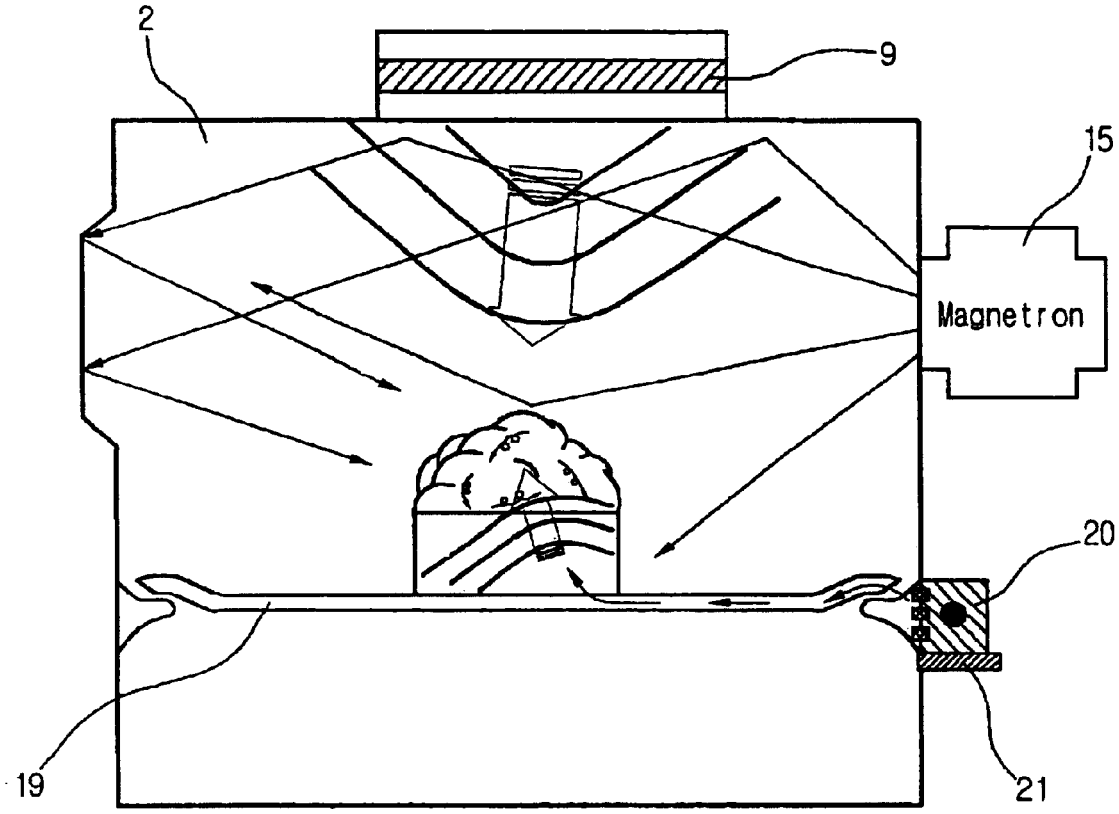
FIG. 4 is an operational state diagram of a microwave oven to which an ultrasonic oscillator is applied according to the present invention.

FIG. 4 is an operational state diagram of the microwave oven to which the ultrasonic oscillator is applied according to the present invention.

As shown in FIG. 4, the microwave oven includes a cavity 2 formed inside of a case; a tray 19 installed inside of the cavity 2, on which a food article is positioned; a heater 9 installed at an upper part and a lower part of the cavity 2, heating the food article inside of the cavity 2 through radiation or convection; and an ultrasonic oscillator 20 installed at a predetermined position of the cavity 2 to be in contact with the tray 19, activating molecular structures of the food article placed on the tray 19 by using ultrasonic waves.

Particularly, the ultrasonic oscillator 20 oscillates ultrasonic waves having a frequency of equal to or higher than 20,000 Hz, an audibility limit. When the ultrasonic waves are oscillated to a solid medium with a very strong molecular structure, intermolecular bonding breaks down by the ultrasonic waves, and the solid medium is destroyed. On the other hand, when the ultrasonic waves are oscillated to a liquid medium that has a relatively weak intermolecular bonding, the liquid gets boiled because of free movement between molecules.

To activate the molecular structures of the food article inside of the cavity 2 by using the ultrasonic waves, and at the same time, to heat the surface of the food article as well as the inside of the food article uniformly by using heat from the heater 9, the tray 19 inside of the cavity 2 is used as a medium of the ultrasonic oscillator 20. To this end, the ultrasonic oscillator 20 is installed at the predetermined outside position of the cavity 2 in contact with the tray 19. The ultrasonic waves oscillated from the ultrasonic oscillator 20 are transmitted to the tray 19, the medium, and eventually to the food article. These transmitted ultrasonic waves activate the molecular structures of the food article.

Moreover, because the tray 19 is employed as the medium for transmission of the ultrasonic waves from the ultrasonic oscillator 20 to the food article, the molecular structures of the food article are well activated, and thus, heating speed applied to the food article is uniform on the surface and inside. As a result, cooking time can be considerably reduced.

Figure 5:
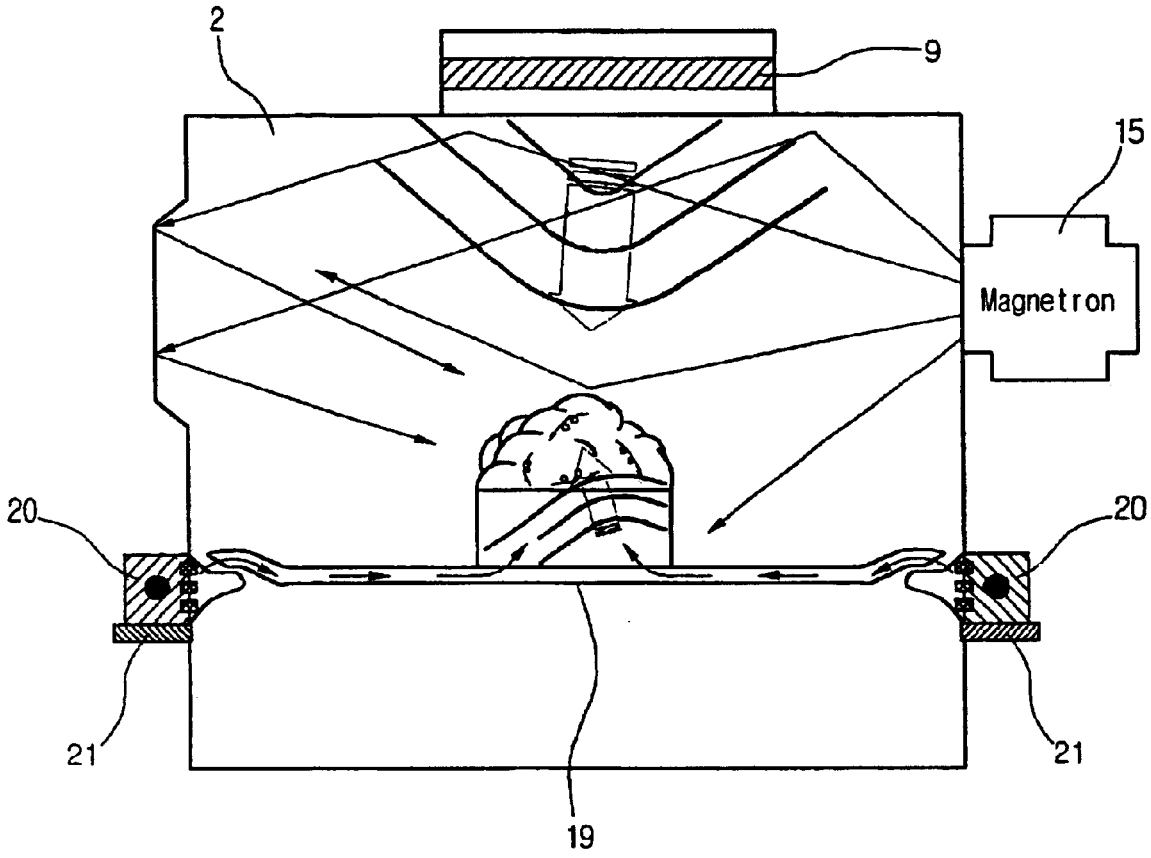
FIG. 5 is an operational state diagram of another embodiment of a microwave oven to which an ultrasonic oscillator is applied.

FIG. 5 is an operational state diagram of another embodiment of the microwave oven to which the ultrasonic oscillator is applied.

As illustrated in FIG. 5, when the ultrasonic oscillator 20 is installed at any position of the top and bottom/right and left side of the cavity 2, the cavity 2 itself is used as a medium of the ultrasonic oscillator 20. Therefore, the cavity 2 transmits the ultrasonic waves to the food article placed at the tray 19, and the molecular structures of the food article are activated thereby.

Now, as for the operation of the microwave oven having the ultrasonic oscillator, when a user places a food article at an inside of the cavity 2 and closes the door 3, the cavity 2 starts cooking the food article while the cavity 2 is being shut by the door 3. At this point, heat from the upper heater 9 installed at the upper end of the cavity 2 is transmitted to the food article through radiation and convection, and simultaneously, the ultrasonic waves from the ultrasonic oscillator 20, which is installed at the predetermined outside position of the cavity 2 in contact with the tray 19, are transmitted to the food article. Especially, the ultrasonic waves from the ultrasonic oscillator 20 are transmitted to the food article via the tray 19 that is used as the medium, and as a result thereof, intermolecular movements of the food article are activated. This in turn activates heat transmission into the food article. When the heater 9 is used to heating the food article while allowing the ultrasonic waves oscillated from the ultrasonic oscillator 20 to activate the molecular structures of the food article, a magnetron 15 also oscillates microwaves. These microwaves are used as another heat source for the food article.

Accordingly, when heat transmission to the food article is increased by activated intermolecular movements of the food article, not only the surface of the food article but also the inside of the food article can be uniformly heated by the heater 9. In this manner, the problem found in the related art heating method of the microwave oven, i.e. burning the surface of the food particle, can be resolved.

As for another embodiment, the oscillating means can be formed in the case, thereby utilizing the case and the tray as the medium of the ultrasonic oscillation.

In conclusion, by using the food article-holding tray inside of the cavity as the medium of the ultrasonic oscillator, the molecular structures of the food article are activated, and thus, heating speed applied to the food article by the heater can be uniform at the surface as well as at the inside of the food article. As the inside and the outside of the food article are heated at a uniform heating speed, cooking time can be greatly reduced.

While the invention has been shown and described with reference to certain preferred embodiments thereof, it will be understood by those skilled in the art that various changes in form and details may be made therein without departing from the spirit and scope of the invention as defined by the appended claims. For example, the oscillating mans can be formed, using the case and the tray as the medium of the ultrasonic oscillation.

Moreover, the ultrasonic oscillator 20 can also be advantageously used for users to clean the interior of the cavity. Specifically speaking, after using the microwave oven for a certain period of time, food particles stuck to the inner wall of the cavity 2 can be easily removed by the ultrasonic waves oscillated from the ultrasonic oscillator 20 because when the ultrasonic waves are transmitted, molecular structures of the food particles are activated and thus, can be easily removed.

The heating apparatus in the microwave oven according to the present invention can also be applied to microwave ovens using a high-frequency wave as a heat source.

As for another embodiment, the heating apparatus of the present invention can be employed to a steaming cooking system using ultrasonic waves, and a heat exchanger using ultrasonic waves to increase uniform heat transmission.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A heating apparatus in a microwave oven having a means for heating an article, comprising:

a cavity formed inside of a case of the apparatus;

a tray installed inside of the cavity, on which the article to be heated is positioned; and an oscillating means formed at the outside of the cavity, connected to the tray, for oscillating the tray such that ultrasonic waves generated by the oscillating means are transmitted to the article through the tray.

2. The heating apparatus according to claim 1, wherein the oscillating means is in contact with the tray, and fastened at a predetermined position on the cavity by means of a fixing means.

3. The heating apparatus according to claim 2, wherein the oscillating means is in contact with the tray, and fastened to the case by using a bracket as a fixing means.

4. The heating apparatus according to claim 3, wherein the bracket and the case are fastened to each other by means of a hook-shaped suspender or a coupling of a bolt and a nut.

5. The heating apparatus according to claim 1, wherein the tray inside of the cavity with the oscillating means that generates ultrasonic waves is used as a medium for transmission of the ultrasonic waves, thereby activating molecular structures of the article to be heated.

6. The heating apparatus according to claim 5, wherein the tray connected to the oscillating means transmits ultrasonic waves to the article to be heated so that molecular structures of the article are activated and heating speed applied to the article is uniform at a surface of the article as well as at an inside of the article.

7. A heating apparatus in a microwave oven having a means for heating an article, comprising:

a cavity formed inside of a case of the apparatus;

a tray installed inside of the cavity, on which the article to be heated is positioned; and an oscillating device formed at the outside of the cavity and connected to the tray for oscillating the tray such that ultrasonic waves generated by the oscillating device are transmitted to the article through the tray.

8. The heating apparatus according to claim 7, wherein the case and the tray are used as a medium of ultrasonic waves to activate molecular structures of the article to be heated.

9. The heating apparatus according to claim 7, wherein the oscillating device installed at a predetermined position of the case.

* * * * *